US007580658B2

(12) United States Patent
Mihara et al.

(10) Patent No.: US 7,580,658 B2
(45) Date of Patent: Aug. 25, 2009

(54) DEVELOPER CONTAINER, DEVELOPER SUPPLY DEVICE, AND IMAGE FORMING APPARATUS

(75) Inventors: Koichi Mihara, Fujidera (JP); Toshihide Ohgoshi, Nara (JP); Hiroshi Kubota, Kadoma (JP); Hideaki Kurimoto, Yamatokoriyama (JP); Masatoshi Kaneshige, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/029,537

(22) Filed: Feb. 12, 2008

(65) Prior Publication Data

US 2008/0199226 A1 Aug. 21, 2008

(30) Foreign Application Priority Data

Feb. 16, 2007 (JP) ..... 2007-037172

(51) Int. Cl.
*G03G 15/08* (2006.01)

(52) U.S. Cl. ..... 399/262; 399/258

(58) Field of Classification Search ..... 399/262, 399/120, 258

See application file for complete search history.

(56) References Cited

U.S. PATENT DOCUMENTS

| | | | | |
|---|---|---|---|---|
| 5,455,662 | A | 10/1995 | Ichikawa et al. | 399/260 |
| 5,500,719 | A | 3/1996 | Ichikawa et al. | 399/238 |
| 5,627,631 | A | 5/1997 | Ichikawa et al. | 399/235 |
| 5,822,663 | A | 10/1998 | Ichikawa et al. | 399/262 |
| 5,918,090 | A | 6/1999 | Ichikawa et al. | 399/120 |
| 5,970,290 | A * | 10/1999 | Yoshiki et al. | 399/262 X |
| 6,075,963 | A | 6/2000 | Ichikawa et al. | 399/262 |
| 6,289,195 | B1 | 9/2001 | Ichikawa et al. | 399/262 |
| 6,766,134 | B2 * | 7/2004 | Nakamura | 399/258 |
| 7,010,236 | B2 * | 3/2006 | Shinkawa et al. | 399/12 |
| 7,368,213 | B2 * | 5/2008 | Nakayama et al. | 430/109.4 |
| 2002/0001485 | A1 | 1/2002 | Ichikawa et al. | 399/262 |
| 2003/0138273 | A1 | 7/2003 | Ichikawa et al. | 399/262 |
| 2003/0185993 | A1 * | 10/2003 | Kamimori et al. | 427/402 |
| 2004/0161267 | A1 | 8/2004 | Ichikawa et al. | 399/262 |
| 2005/0265752 | A1 * | 12/2005 | Nagahama et al. | 399/262 |

(Continued)

FOREIGN PATENT DOCUMENTS

| | | |
|---|---|---|
| JP | 07-20705 | 1/1995 |

(Continued)

OTHER PUBLICATIONS

Machine translation of JP 2003-263015 A dated Dec. 14, 2008.*

*Primary Examiner*—Sophia S Chen
(74) *Attorney, Agent, or Firm*—Nixon & Vanderhye PC

(57) ABSTRACT

A toner bottle stores toner in a cylindrical section having an inner circumferential surface provided with a plurality of protruding portions raised inward the cylindrical section. When the cylindrical section is driven to rotate on its central axis, the toner is discharged from the cylindrical section via an outlet. When cross-sections perpendicular to the central axis of the cylindrical section are projected from a longitudinal direction of the cylindrical section, the cylindrical section has an inner circumference provided with one or more regions where the protruding portions are not projected. This prevents the toner from making contact with the protruding portions. Therefore, the toner can be conveyed while suppressing the generation of frictional heat by reducing the resistance between the toner and the protruding portions.

12 Claims, 12 Drawing Sheets

U.S. PATENT DOCUMENTS

| | | | | |
|---|---|---|---|---|
| 2006/0034642 | A1 | 2/2006 | Taguchi et al. | 399/258 |
| 2008/0118278 | A1* | 5/2008 | Takesue et al. | 399/263 |

FOREIGN PATENT DOCUMENTS

| | | | |
|---|---|---|---|
| JP | 07-20795 | | 1/1995 |
| JP | 10-171227 | | 6/1998 |
| JP | 2003-263015 | A * | 9/2003 |
| JP | 2003-345114 | | 12/2003 |
| JP | 2005-070626 | A * | 3/2005 |
| JP | 2005-140908 | | 6/2005 |
| JP | 2006-71762 | | 3/2006 |
| JP | 2007-102135 | A * | 4/2007 |

* cited by examiner

FIG. 12(a)

| EXAMPLE | NUMBER OF PROTRUDING PORTIONS ON CROSS-SECTIONAL CIRCUMFERENCE | ANGLE CIRCUMFERENTIALLY FORMED BY PROTRUDING PORTION WITH CENTRAL AXIS | PRESENCE OR ABSENCE OF OVERLAP OF PROTRUDING PORTIONS ON CROSS-SECTION | PROPORTION NONFORMATION OF PROTRUDING PORTIONS WITH RESPECT TO ENTIRE CIRCUMFERENCE OF BOTTLE (%) | TONER CONVEYABILITY |
|---|---|---|---|---|---|
| TEST 1 | 3 | 100° | ABSENT | 16.7 | TONER CONVEYABILITY DETERIORATED |
| TEST 2 | 3 | 105° | ABSENT | 12.5 | NO PROBLEM |
| TEST 3 | 3 | 115° | ABSENT | 4.2 | NO PROBLEM |
| TEST 4 | 3 | 120° | ABSENT | 0 | TONER COAGULATED |
| TEST 5 | 3 | 125° | PRESENT | — | TONER COAGULATED |
| TEST 6 | 3 | 150° | PRESENT | — | TONER COAGULATED |
| TEST 7 | 4 | 75° | ABSENT | 16.7 | TONER CONVEYABILITY DETERIORATED |
| TEST 8 | 4 | 80° | ABSENT | 11.1 | NO PROBLEM |
| TEST 9 | 4 | 85° | ABSENT | 5.6 | NO PROBLEM |
| TEST 10 | 4 | 90° | ABSENT | 0 | TONER COAGULATED |
| TEST 11 | 4 | 95° | PRESENT | — | TONER COAGULATED |
| TEST 12 | 4 | 110° | PRESENT | — | TONER COAGULATED |

FIG. 12(b)

| EXAMPLE | NUMBER OF PROTRUDING PORTIONS ON CROSS-SECTIONAL CIRCUMFERENCE | ANGLE CIRCUMFERENTIALLY FORMED BY PROTRUDING PORTION WITH CENTRAL AXIS | HEIGHT OF PROTRUDING PORTIONS | TONER CONVEYABILITY |
|---|---|---|---|---|
| TEST 13 | 3 | 105° | 9mm | TONER COAGULATED |
| TEST 14 | 3 | 105° | 8mm | NO PROBLEM |
| TEST 2 | 3 | 105° | 7mm | NO PROBLEM |
| TEST 15 | 3 | 105° | 6mm | NO PROBLEM |
| TEST 16 | 3 | 105° | 5mm | NO PROBLEM |
| TEST 17 | 3 | 105° | 4mm | LOW CONVEYABILITY |
| TEST 18 | 4 | 85° | 9mm | TONER COAGULATED |
| TEST 19 | 4 | 85° | 8mm | NO PROBLEM |
| TEST 9 | 4 | 85° | 7mm | NO PROBLEM |
| TEST 15 | 4 | 85° | 6mm | NO PROBLEM |
| TEST 16 | 4 | 85° | 5mm | NO PROBLEM |
| TEST 17 | 4 | 85° | 4mm | LOW CONVEYABILITY |

FIG. 12(c)

| EXAMPLE | NUMBER OF PROTRUDING PORTIONS ON CROSS-SECTIONAL CIRCUMFERENCE | ANGLE CIRCUMFERENTIALLY FORMED BY PROTRUDING PORTION WITH CENTRAL AXIS | TILT OF PROTRUDING PORTIONS WITH RESPECT TO CENTRAL AXIS OF BOTTLE | TONER CONVEYABILITY |
|---|---|---|---|---|
| TEST 18 | 3 | 105° | 5° | TONER COAGULATED |
| TEST 19 | 3 | 105° | 10 | NO PROBLEM |
| TEST 20 | 3 | 105° | 15 | NO PROBLEM |
| TEST 21 | 3 | 105° | 30 | NO PROBLEM |
| TEST 22 | 3 | 105° | 40 | ALMOST NO PROBLEM |
| TEST 23 | 3 | 105° | 45 | LOW CONVEYABILITY |
| TEST 24 | 4 | 85° | 5° | TONER COAGULATED |
| TEST 25 | 4 | 85° | 10 | NO PROBLEM |
| TEST 26 | 4 | 85° | 15 | NO PROBLEM |
| TEST 27 | 4 | 85° | 30 | NO PROBLEM |
| TEST 28 | 4 | 85° | 40 | ALMOST NO PROBLEM |
| TEST 29 | 4 | 85° | 45 | LOW CONVEYABILITY |

FIG. 12(d)

| EXAMPLE | NUMBER OF PROTRUDING PORTIONS ON CROSS-SECTIONAL CIRCUMFERENCE | ANGLE CIRCUMFERENTIALLY FORMED BY PROTRUDING PORTION WITH CENTRAL AXIS | AMOUNT ADDED (wt%) | NUMBER OF SHEETS PRINTED BEFORE TONER COAGULATION (NUMBER OF A4 SHEETS) |
|---|---|---|---|---|
| TEST 2 | 3 | 105° | — | 100K |
| TEST 30 | 3 | 105° | 5 | 125K |
| TEST 31 | 3 | 105° | 10 | 133K |
| TEST 9 | 4 | 85° | — | 104K |
| TEST 32 | 4 | 85° | 5 | 131K |
| TEST 33 | 4 | 85° | 10 | 126K |

DEVELOPER CONTAINER, DEVELOPER SUPPLY DEVICE, AND IMAGE FORMING APPARATUS

This Nonprovisional application claims priority under 35 U.S.C. § 119(a) on Patent Application No. 037172/2007 filed in Japan on Feb. 16, 2007, the entire contents of which are hereby incorporated by reference.

FIELD OF THE TECHNOLOGY

The present disclosure relates to developer containers. Particularly, the disclosure relates to a developer container which, when driven to rotate, discharges developer stored therein, a developer supply device including the developer container, and an image forming apparatus including the developer supply device.

BACKGROUND OF THE TECHNOLOGY

In an electrophotographic image forming apparatus, an electrostatic latent image formed on a surface of a photoreceptor is developed with toner by a developing device. The toner for use in the development of the electrostatic latent image is stored in a toner container (such as a toner cartridge or a toner bottle), and the toner is sequentially supplied from the toner container to the developing device.

Since high-speed image forming apparatuses consume a large amount of toner, the image forming apparatuses use capacious toner containers. Among the toner containers, rotary toner bottles have been conventionally used since the rotary toner bottles can control the discharge amount of toner with high precision. In many cases, such a toner bottle is formed so as to have a hollow cylindrical section, one end of which is closed and the other end of which has an outlet provided thereby. Further, such a toner bottle is mounted in an image forming apparatus so that the cylindrical section has a horizontal axis. Furthermore, some of such toner bottles have an inner circumferential surface provided with spiral protruding portions. When such a toner bottle is driven to rotate on its axis, the protruding portions provided on the inner circumferential surface convey toner while guiding the toner toward the outlet. As a result, an amount of toner corresponding to the rotation is discharged via the outlet.

In recent years, in order to reduce the power consumption of an image forming apparatus, an attempt to lower the melting point of toner has been made. This has caused a subtle change in fluidity of the toner, thereby making the toner likely to coagulate in a toner container. The likelihood becomes strong especially under hot and humid conditions. As a result, the toner coagulated in the toner container cannot be discharged successfully, and accumulates in the toner container. Finally, even though the toner remains in the toner container, the toner container is judged to be "out of toner", a signal to replace the toner container is transmitted. This leaves no choice but "toner replacement" even though the toner has not been finished up. This brings about a very uneconomic situation.

As measures against such a situation, Patent Document 1 (Japanese Unexamined Patent Application Publication No. 140908/2005 (Tokukai 2005-140908; published on Jun. 2, 2005)) and Patent Document 2 (Japanese Unexamined Patent Application Publication No. 71762/2006 (Tokukai 2006-71762; published on Mar. 16, 2006)) disclose a technique for forcibly preventing toner from coagulating, or for discharging coagulated toner, by providing a scraping member in a toner container.

SUMMARY OF THE DISCLOSURE

However, the conventional technique causes an increase in cost since it provides a scraping member and the like. Further, in order to improve the slidability of toner, an attempt to coat the inner surface of a toner container with fluorine and an attempt to mold a toner container with use of a material obtained by mixing an ingredient such as fluorine into a resin have been made. However, it is very much a situation in which even such attempts have failed to bring about any remarkable effects.

The present disclosure has been made in view of the foregoing problems, and it is an object to provide a developer container that can be manufactured while reducing costs and that can prevent a developer from coagulating and remaining in the container, a developer supply device including the developer container, and an image forming apparatus including the developer supply device.

In order to solve the foregoing problems, a developer container comprises a cylindrical section containing developer therein, the cylindrical section having an inner circumferential surface provided with a plurality of protruding portions raised inward the cylindrical section, which is arranged such that when the cylindrical section is driven to rotate on a central axis of the cylindrical section, the developer stored in the cylindrical section is conveyed along the central axis by the plurality of protruding portions so as to be discharged an outlet of the cylindrical section, wherein when cross-sections perpendicular to the central axis of the cylindrical section are projected from a longitudinal direction of the cylindrical section, the cylindrical section has an inner circumference provided with one or more regions where the protruding portions are not projected.

According to the foregoing arrangement, when a cylindrical section provided with a plurality of protruding portions raised toward an inner side of the cylindrical section so as to convey a developer is cut perpendicularly to a central axis of rotation and projected from a longitudinal direction of the cylindrical section, the cylindrical section has an inner circumference provided with one or more regions where the protruding portions are not projected. That is, when projected as above, the plurality of protruding portions raised toward the inner side of the cylindrical section so as to convey the developer are not formed entirely on the inner circumference of the cylindrical section, i.e., are disconnected from one another. This prevents the developer from making contact with the plurality of protruding portions. Therefore, the developer can be conveyed while suppressing the generation of frictional heat by reducing the resistance between the developer and the protruding portions. Since the generation of heat can be thus suppressed, the developer can be prevented from coagulating, so that the conveyability of the developer can be ensured. Further, the conventional need for a member for scraping a coagulated developer is eliminated. This makes it possible to reduce costs.

Additional objects, features, and strengths of the technology will be made clear by the description below. Further, the advantages will be evident from the following explanation in reference to the drawings.

BRIEF DESCRIPTION OF THE DRAWINGS

FIG. 1(*b*) is a diagram obtained by projecting, from the longitudinal direction of a cylindrical section of the toner bottle of FIG. 1(*a*), a cross-section of the cylindrical section taken along the dashed line X-X of FIG. 1(*a*).

FIGS. 12(*a*) through 12(*d*) show results obtained by studying examples of the present technology.

DESCRIPTION OF THE EMBODIMENTS

Figure 1:
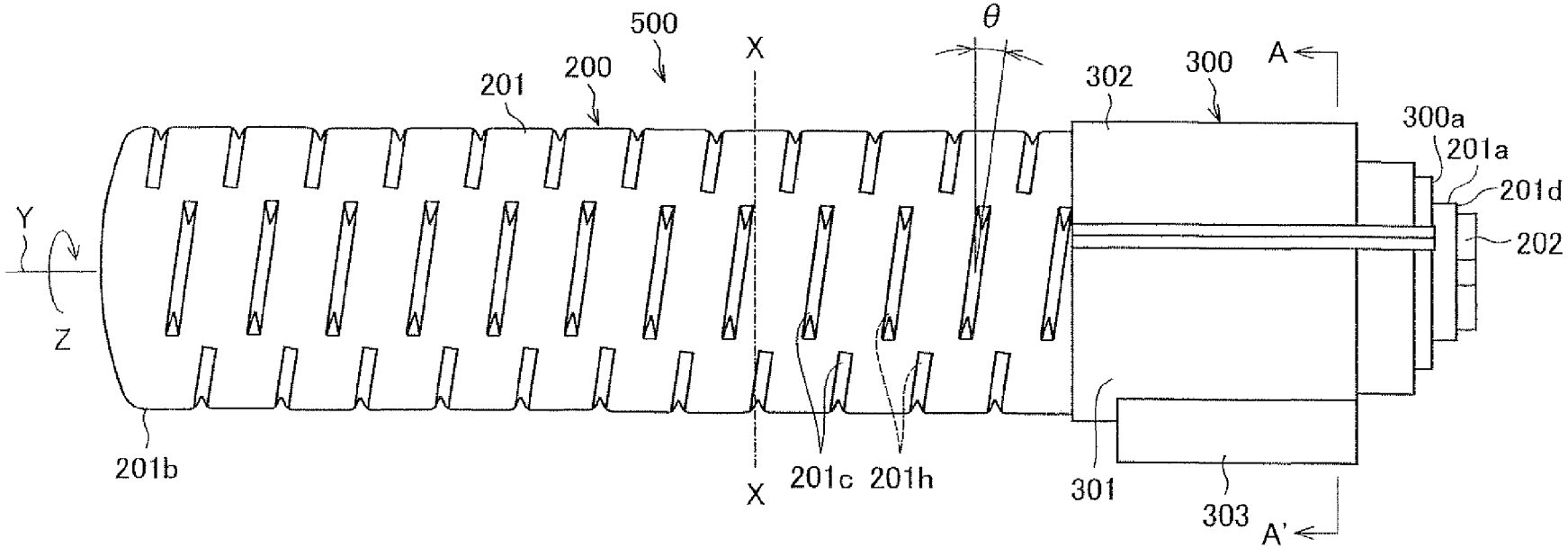
FIG. 1(*a*) is a side view of a toner supply section including a toner bottle.
Figure 1:
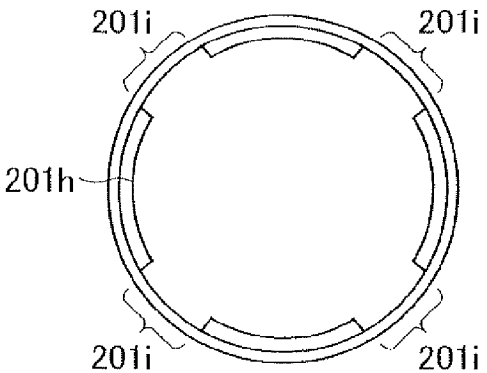

An embodiment of the present technology will be described below with reference to FIGS. 1(*a*) through 12(*d*). FIG. 2 is a traverse sectional view schematically showing an arrangement of a multifunctional apparatus serving as an image forming apparatus. The present embodiment describes the image forming apparatus by taking the multifunctional apparatus as an example of the image forming apparatus. However, the present technology is not limited to this. Examples of the image forming apparatus may include printers, fax machines, and copiers.

The image forming apparatus (multifunctional apparatus) 101 of FIG. 2 electro photographically forms a multicolor or monochrome image on a recording paper sheet in accordance with a print job sent from an information processing apparatus such as an external personal computer with or without wires, or in accordance with image data obtained by scanning a document with use of a document reading unit.

As shown in FIG. 2, the image forming apparatus 101 mainly includes a document reading unit 110, an image forming unit 120, and a paper feeding unit 130. The paper feeding unit 130 has four paper sheet cassettes 142*a* to 142*d* in which recording paper sheets are stored. The image forming unit 120 forms an image by a Carlson process on a recoding paper sheet fed from any one of the paper sheet cassettes. The document reading unit 110 creates image data by scanning a document placed on a document table.

More specifically, the image forming unit 120 forms a multicolor image by superimposing a black (BK) toner image, a cyan (C) toner image, a magenta (M) toner image, and a yellow (Y) toner image onto one another. For this purpose, the image forming unit 120 includes four photoreceptor drums 21*a* to 21*d*, respectively corresponding to BK, C, M, and Y, around each of which a charging device, a developing device, a transfer roller, and a cleaning member are provided. Thus, the image forming unit 120 serves as a tandem color image forming unit.

The image forming unit 120 further includes an exposure unit 10, an intermediate transfer belt 31, a transfer roller 36, a fixing device 27, and the like.

Each of the photoreceptor drums 21*a* to 21*d* is an organic photoreceptor obtained with use of an organic photo conductor (OPC).

The exposure unit 10 has a laser scanning unit, a polygonal mirror, an fθ lens, reflecting mirrors, and the like. In the exposure unit 10, a laser beam emitted from the laser scanning unit is separated into laser beams having different colors, and then the laser beams are reflected by the reflecting mirrors so as to be sent upon the photoreceptor drums 21*a* to 21*d*, respectively.

Each of the developing devices 23*a* to 23*d* has a developer tank, a stirring roller, a developing roller, a doctor blade, and the like. Each of the developing devices 23*a* to 23*d* develops an image with use of a two-component developer prepared by mixing carrier with toner. Each of the developing devices 23*a* to 23*d* develops an image (i) by using the stirring roller to mix carrier with toner supplied into the developer tank, (ii) by forming, on the developing roller, a magnetic brush whose height of hairs has been appropriately adjusted by the doctor blade, and then (iii) by causing the magnetic brush to make contact with a corresponding one of the photoreceptor drums 21*a* to 21*d* under a developing bias.

In order to supply black (BK) toner, cyan (C) toner, magenta (M) toner, and yellow toner (Y) to the developing devices 23*a* to 23*d*, respectively, the image forming apparatus 101 has toner supply devices 100*a* to 100*d* respectively located above the developing devices 23*a* to 23*d*. The toner supply devices 100*a* to 100*d* have toner bottles in which the black toner, the cyan toner, the magenta toner, and the yellow toner (Y) are stored, respectively. Each of the toner bottles can be replaced when it runs out of toner. The toner bottles will be fully described later. Note that the image forming apparatus 101 has two toner supply devices 100*a* both corresponding to the black toner, which is consumed in large amounts. Further, each of the respective toner bottles of the toner supply devices 100*a* to 100*d* may contain an appropriate amount of carrier in addition to the corresponding toner.

The intermediate transfer belt 31 is an endless belt stretched by a driving roller and a driven roller, and makes contact with respective surfaces of the photoreceptor drums 21*a* to 21*d*. Further, the intermediate transfer belt 31 also makes contact with a paper sheet conveying path. The transfer roller 36 is provided in a place of contact between the intermediate transfer belt 31 and the paper sheet conveying path so as to face the intermediate transfer belt 31.

The fixing device 27 has a fixing roller and a pressure roller. When a recording paper sheet onto which a toner image has been transferred is sandwiched between these two rollers, the toner image is fixed onto the recording paper sheet.

The following describes a process of forming an image in the image forming apparatus 101.

First, the surfaces of the photoreceptor drums 21*a* to 21*d* are uniformly charged by the charging devices, respectively. Next, when those regions of the surfaces of the photoreceptor drums 21*a* to 21*d* which have been uniformly charged is exposed to light by the exposure unit 10, electrostatic latent images are formed on the surfaces of the photoreceptor drums 21*a* to 21*d*, respectively. These electrostatic latent images are created so as to respectively correspond to color components contained in the image.

Then, the electrostatic latent images formed on the surfaces of the photoreceptor drums 21*a* to 21*d* so as to correspond to the color components are developed by the developing devices 23*a* to 23*d*, respectively. This causes a black (BK) toner image, a cyan (C) toner image, a magenta (M) toner image, and a yellow (Y) toner image to be formed on the surfaces of the photoreceptor drums 21*a* to 21*d*, respectively. The toner images formed on the surfaces of the photoreceptor drums 21*a* to 21*d* respectively are transferred onto the intermediate transfer belt 31 so as to be superimposed onto one another. This causes the desired multicolor image to be formed as a toner image on the intermediate transfer belt 31.

Meanwhile, a recording paper sheet is picked up from any one of the paper sheet cassettes of the paper feeding unit 130, and then is conveyed through the paper sheet conveying path. The recording paper sheet thus conveyed reaches a point at which the transfer belt 36 is provided, and then is pressed against the intermediate transfer belt 31 by the transfer roller 36. It should be noted here that a transfer electric field is formed between the transfer roller 36 and the intermediate transfer belt 31, and that this electric field has such an effect that the toner image formed on the intermediate transfer belt 31 is transferred onto the recording paper sheet.

The recording paper sheet onto which the toner image has been transferred is further conveyed, and the toner image is fixed onto the recording paper sheet by the fixing device 27. Then, the recording paper sheet is ejected onto a paper ejection tray. This is the end of the image forming process.

The following fully describes respective structures of the developing devices 23*a* to 23*d* and toner supply devices 100*a* to 100*d* of the present embodiment.

Figure 3:
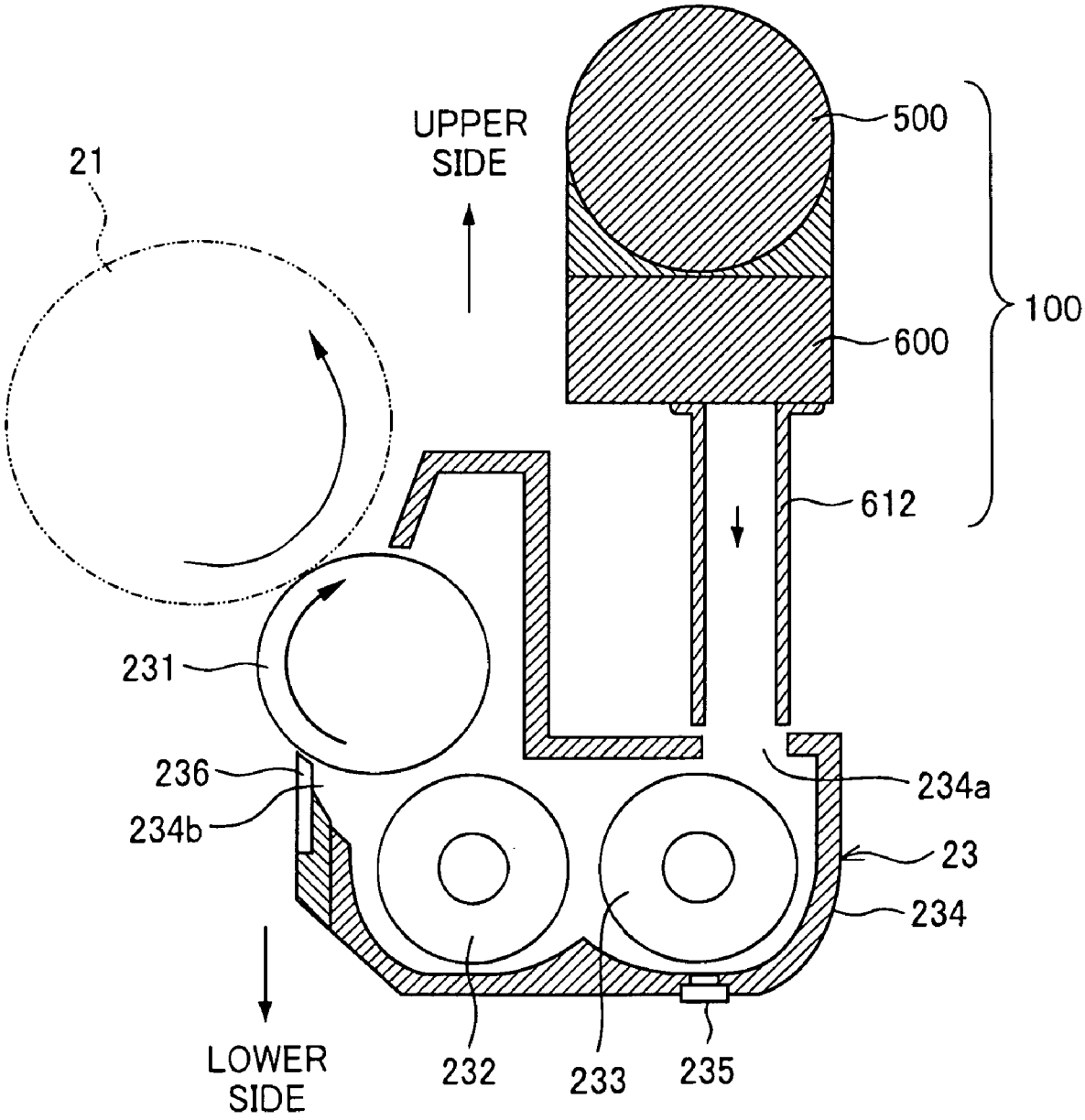
FIG. 3 is a traverse sectional view schematically showing a developing device and a toner supply device each provided in the image forming apparatus.

The developing devices 23*a* to 23*d* basically have the same structure; therefore, the developing devices 23*a* to 23*d* are referred to collectively as "developing device 23". The same applies to the toner supply devices 100*a* to 100*d*; therefore, the toner supply devices 100*a* to 100*d* are referred to collectively as "toner supply device 100", and the photoreceptor drums 21*a* to 21*d* are referred to collectively as "photoreceptor drum 21". FIG. 3 shows an embodiment of the present invention, and is a traverse sectional view schematically showing respective structures of the developing device 23 and the toner supply device 100.

As shown in FIG. 3, the developing device 23 has a developing roller 231, a first toner conveying roller 232, a second toner conveying roller 233, a toner tank 234, a toner density sensor 235, and a doctor blade 236.

The toner tank 234 serves as an outer covering of the developing device 23, and has an upper portion provided with an opening serving as a toner inlet 234*a* through which a developer is introduced. Further, the toner tank 234 has an opening portion 234*b* provided so as to face a photoreceptor drum 21. Provided in the toner tank 234 are the developing roller 231, the first toner conveying rollers 232, and the second toner conveying roller 233.

The developing roller 231 is provided near the opening portion 234*b* provided in the toner tank 234. The developing roller 231 is exposed from the opening 234*b* so as to make contact with or be adjacent to the photoreceptor drum 21. The developing roller 231 serves as a magnet roller by which the aforementioned magnetic brush is formed.

The first toner conveying roller 232 and the second toner conveying roller 233 are disposed at the bottom of the toner tank 234 so as to be parallel with the developing roller 231, and convey toner from the toner tank 234 to the developing roller 231 while stirring the toner together with carrier in the toner tank 234. Further, at the bottom of the toner tank 234, the toner density sensor 235 is provided. The toner density sensor 235 is a magnetic permeability sensor that detects the proportion of the toner to the carrier in the toner tank 234.

Provided above the developing device 23 thus arranged is the toner supply device 100. As shown in FIG. 3, the toner supply device 100 mainly includes a toner supply section 500 for supplying toner, a supporting member 600 for supporting the toner supply section 500, a toner conveying path 612 through which the toner is guided from the toner supply section 500 to the developing device 23, and a driving device (not shown).

Figure 2:
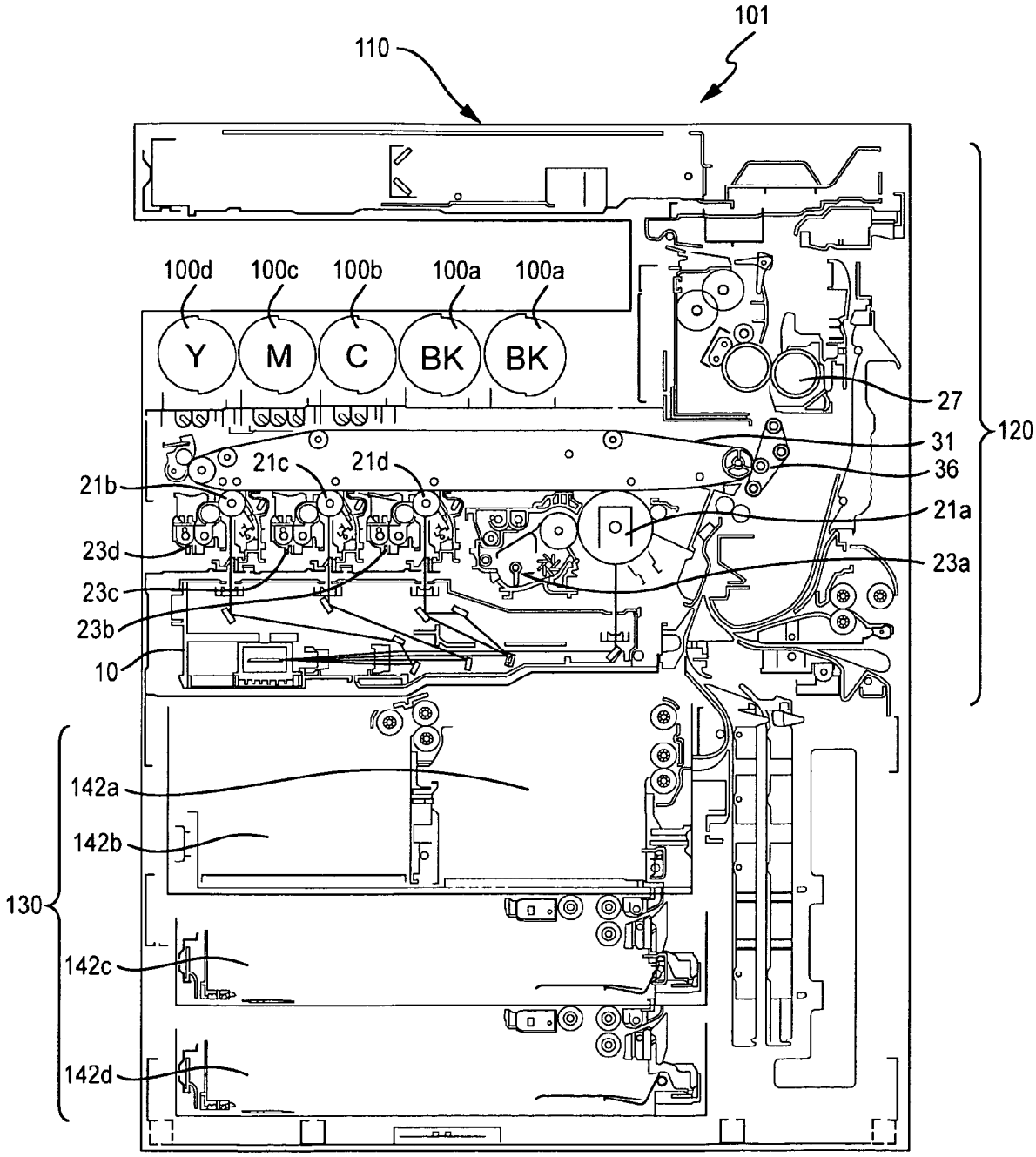
FIG. 2 is a traverse sectional view schematically showing an arrangement of an image forming apparatus having the toner supply section.

FIG. 1(*a*) shows an embodiment of the present invention, and is a side view showing a structure of the toner supply section 500. As shown in FIG. 1(*a*), the toner supply section 500 has a toner bottle 200 (developer container) in which a developer serving as toner is stored and a bottle holding member 300 rotatably holding an end of the toner bottle 200.

Figure 4:
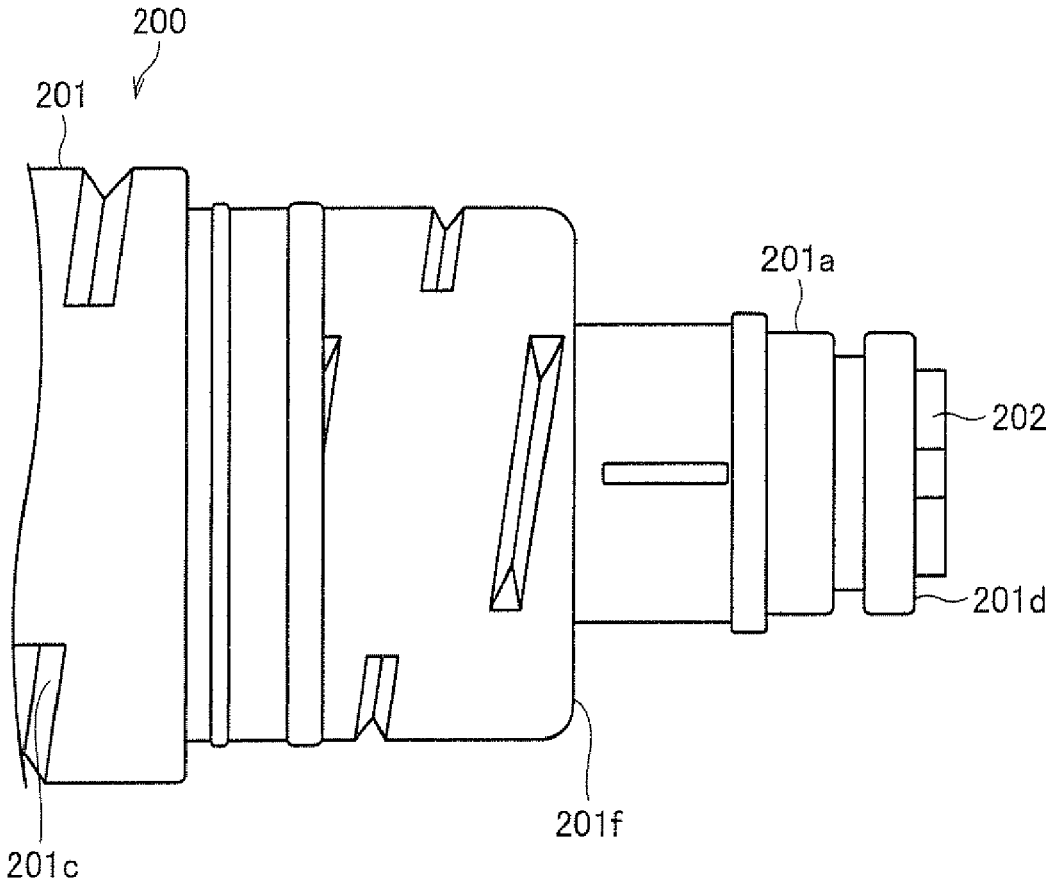
FIG. 4 is a side view showing a structure of the vicinity of a top end portion of the toner bottle of FIG. 1(*a*).

The toner bottle 200 has a cylindrical section 201 formed so as to have a substantially cylindrical shape. The cylindrical section 201 has a top end portion 201*a* that is to be held by the bottle holding member 300. FIG. 4 is a side view showing a structure of the vicinity of the top end portion 201*a* of the toner bottle 200. As shown in FIG. 4, provided in a region where a step is formed between a central portion of the cylindrical section 201 and the top end portion 201*a* is an outlet 201*f* via which toner is discharged from the cylindrical section 201. The region, provided with the outlet 201*f*, which is held by the bottle holding member 300 is referred to as "toner discharging section". The toner discharged via the outlet 201*f* is temporarily stored in the bottle holding member 300 provided so as to cover an outer circumferential surface near the top end portion 201*a*.

In FIG. 1(*a*), the cylindrical section 201 has a circumferential surface having a region, located near the top end portion 201*a*, which is covered with the bottle holding member 300. Therefore, FIG. 1(*a*) does not show the outlet 201*f*. Meanwhile, the cylindrical section 201 has a rear end portion 201*b* located on opposite side of the top end portion 201*a*. The rear end portion 201*b* is closed.

The cylindrical section 201 has an outer circumferential surface provided with a plurality of groove portions 201*c* depressed toward the inside of the cylindrical section 201.

FIG. 1(*b*) is a diagram obtained by projecting, from the longitudinal direction of the cylindrical section 201, a cross-section of the toner supply section 500 of FIG. 1(*a*) taken along the dashed line X-X. As shown in FIG. 1(*b*), the cylindrical section 201 has an inner circumferential surface on which regions corresponding to the groove portions 201*c* serve as protruding portions 201*h* shaped so as to protrude toward the central axis (axis of rotation) Y. When that cross-section of the cylindrical section 201 which is perpendicular to the central axis Y is projected from the longitudinal direction of the cylindrical section 201, it is found that the cylindrical section 201 has an inner circumference provided with regions 201*i* where the protruding portions 201*h* are not projected.

As shown in FIG. 1(*a*), the protruding portions 201*h* (groove portions 201*c*) extend so as to be tilted at θ from a direction perpendicular to the central axis Y toward a developer (toner) conveying direction, and the protruding portions 201*h* are disposed so as not to be on an extension of one another. That is, a large number of protruding portions 201*h* are provided not continuously but periodically on an inner surface of the cylindrical section 201. The present embodiment assumes that θ is approximately 15°. It is preferable that θ fall within a range of 10° to 40°. Further, the protruding portions 201*h* are repeatedly disposed in a given shape from the rear end portion 201*b* to a near side of the toner discharging section provided with the outlet 201*f*. Further, the protruding portions 201*h* are provided along the axis Y of the cylindrical section 201 so as to be parallel with one another.

Further, as evidenced by FIG. 1(*b*), when that cross-section of the cylindrical section 201 which is perpendicular to the central axis Y is projected from the longitudinal direction of the cylindrical section 201, it is found that the protruding portions 201*h* are not formed entirely on the inner circumference of the cylindrical section 201. That is, the protruding portions 201*h* are disconnected from one another somewhere on the inner circumference of the cylindrical section 201. This makes it possible to prevent the toner from making contact with the protruding portions 201*h*. Therefore, the toner can be conveyed while suppressing the generation of frictional heat by reducing the resistance between the toner and the protruding portions 201*h*. Since the generation of frictional heat can be thus suppressed, the toner can be prevented from coagulating, so that the conveyability of the toner can be ensured. Therefore, the coagulation of coagulation-prone toner (e.g., toner with a high wax content) can be prevented by minimizing heat generated by the protruding portions 201*h*.

The conveyability of the toner is slightly reduced in the regions 201*i*, provided on the inner circumference of the cylindrical section 201, where the protruding portions 201*h* are not projected. However, the rotation of the cylindrical section 201 causes the subsequent protruding portions 201*h* to follow up the conveyability, thereby preventing a large reduction in conveyability.

The toner bottle 200 having these protruding portions 201*h* (groove portions 201*c*) can be prepared, for example, from a PE resin or an ABS resin by metal molding. It is preferable that the toner bottle 200 (cylindrical section 201) be formed from a material to which azomethine pigment has been added. This is because such a material gives the toner bottle 200 excellent heat-shielding properties. The excellent heat-shielding properties make it possible to prevent heat from being transmitted from the outside of the toner bottle 200 to the toner stored in the toner bottle 200, and to thereby prevent the toner from coagulating.

The toner bottle 200 is mounted in the image forming apparatus 101 so as be in a state shown in FIG. 1(*a*), i.e., so that the central axis Y of the cylindrical section 201 becomes horizontal. Further, the toner bottle 200 is driven to rotate on the central axis Y of the cylindrical section 201 in the direction Z of FIG. 1(*a*).

When the toner bottle 200 is driven to rotate, the toner stored in the cylindrical section 201 is guided by the protruding portions 201*h* so as to be conveyed from the rear end portion 201*b* to the outlet 201*f*. Then, after arriving at the outlet 201*f*, the toner is discharged.

Figure 5:
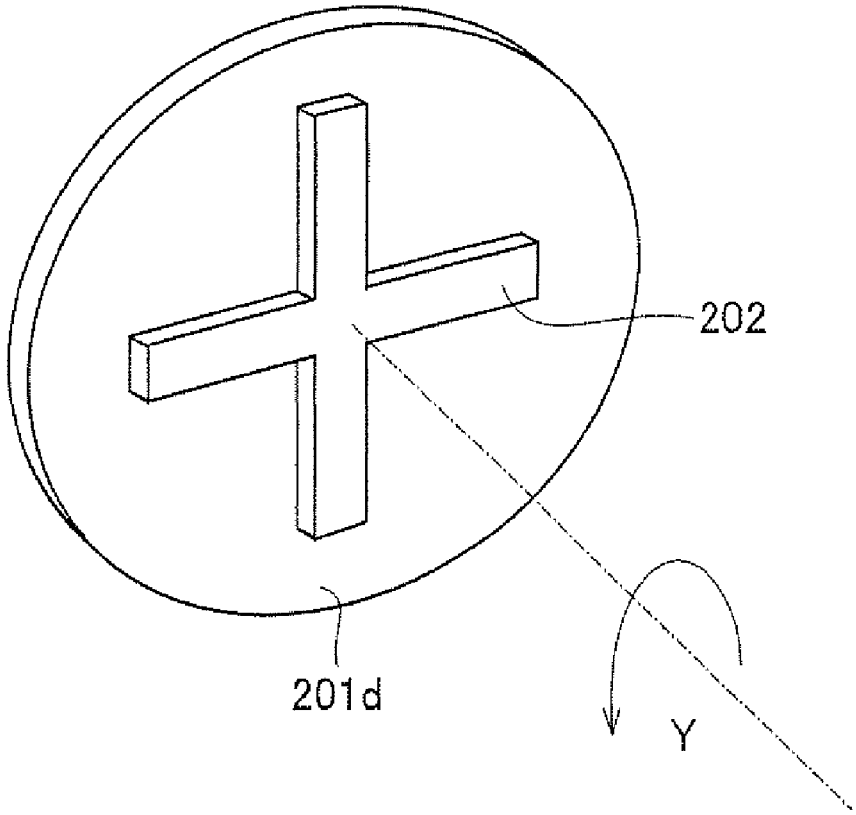
FIG. 5 is a perspective view showing the shape of a connecting part provided on the top end portion of FIG. 4.
Figure 6:
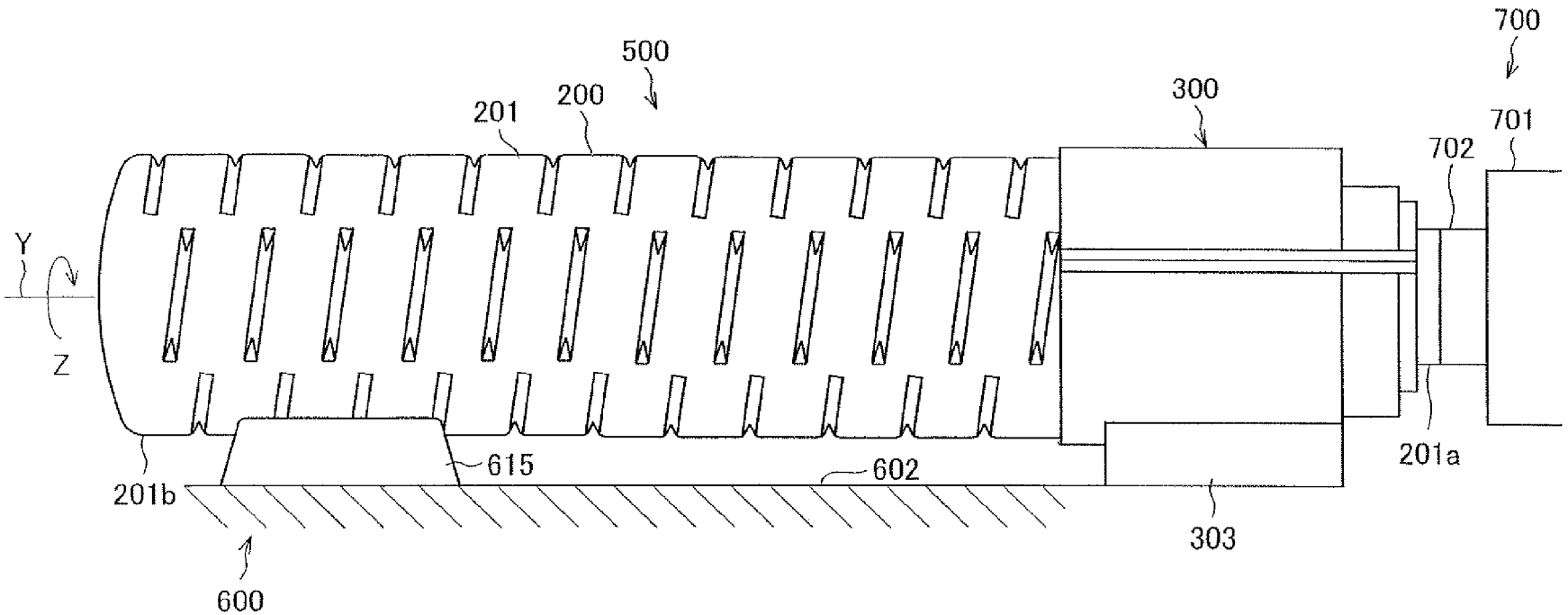
FIG. 6 illustrates that the toner supply section of FIG. 1(*a*) is supported by a supporting member so as to be connected to a driving device for driving the toner bottle to rotate.

As shown in FIG. 4, the top end portion 201*a* is formed so as to have a cylindrical shape whose diameter is smaller than the central portion of the cylindrical section 201. The top end portion 201*a* has a top end surface 201*d* from which a connecting part 202 protrudes outward. FIG. 5 is a perspective view showing a structure of the connecting part 202. FIG. 6 illustrates that the toner supply section 500 is supported by a supporting member 600 so as to be connected to a driving device 700 for driving the toner bottle 200 to rotate. The connecting part 202 of FIG. 5 is designed to engage with a connection part 702 of a driving motor 701 of the driving device 700 when the toner supply device 100 is mounted in the image forming apparatus 101. This causes the toner bottle 200 of the toner supply section 500 to rotate by receiving driving force from the driving device 700 via the connecting part 202.

As shown in FIG. 6, the driving device 700 having the driving motor 701 and the connecting part 702 is provided so as to face the top end portion 201*a* of the toner bottle 200, and the connection part 702 of the driving device 700 engages transversely with the top end portion 201*a* of the toner bottle 200 in a horizontal direction. More specifically, the connecting part 702 of the driving device 700 has an end, provided with a depressed portion (not shown) that engages with the connecting part 202 of the toner bottle 200, which faces the toner bottle 200. The aforementioned engagement is carried out when the depressed portion engages with the connecting portion 202.

Meanwhile, the other end of the connecting part 702 is connected to the driving motor 701. With this arrangement, the rotation of the driving motor 701 on the central axis Y in the direction Z transmits torque to the toner bottle 200 via the connecting part 702, thereby driving the toner bottle 200 to rotate on the central axis Y in the direction Z.

When the toner bottle 200 is driven to rotate on the axis Y in the direction Z, the protruding portions 201*h* provided on the inner circumferential surface of the cylindrical section 201 of the toner bottle 200 cause the toner to be conveyed from the toner bottle 200 to the top end portion 201*a* and then to be discharged from the toner bottle 200 into the bottle holding member 300 via the outlet 201*f*. Then, the toner discharged into the bottle holding member 300 is further discharged from that toner discharging section of the bottle holding member 300 which is provided with a shutter 400, and then is supplied to the developing device 23 through the toner conveying path 612.

Figure 7:
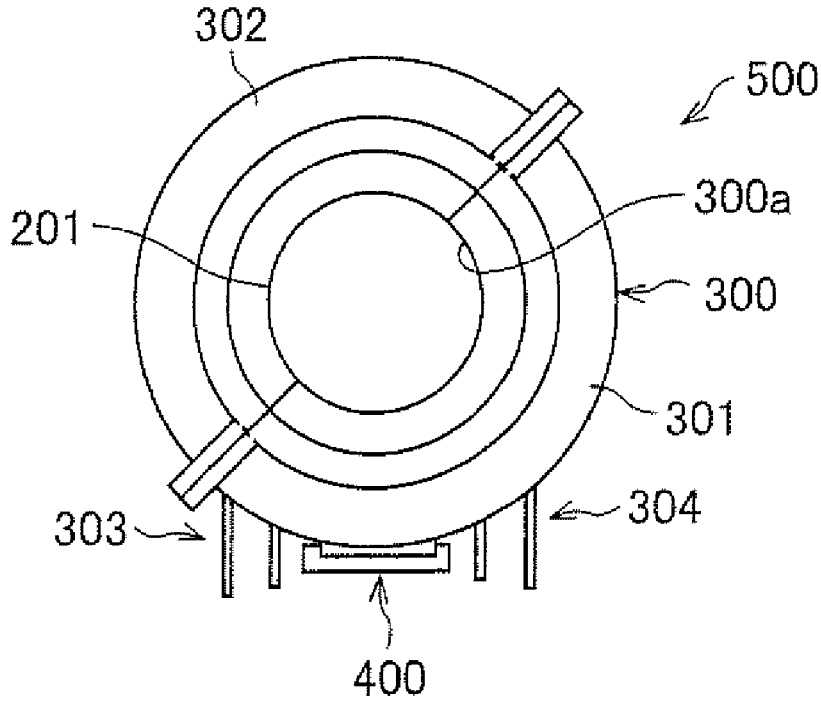
FIG. 7 is a cross-sectional view of the toner supply section of FIG. 1(*a*) taken along the line A-A'.

FIG. 7 is a cross-sectional view of the toner supply section 500 taken along the line A-A'. As shown in FIG. 7, provided on a bottom surface of the bottle holding member 300 (surface that faces down when the toner supply device 100 is mounted in the image forming apparatus 101) is the shutter 400 for opening and closing the toner discharging section through which the toner discharged from the toner bottle 200 is further discharged from the bottle holding member 300. That is, when the shutter 400 opens the toner discharging section of the bottle holding member 300, the toner discharging section becomes communicated with the toner conveying path 612, so that the toner is supplied from the toner supply section 500 to the developing device 23 through the toner conveying path 612.

As shown in FIGS. 1(*a*) and 7, the bottle holding member 300 is formed so as to have a cylindrical shape both ends of which are open, and is constituted by a first housing 301 and a second housing 302 that are joined to each other so as to cover the outer circumferential surface near the top end portion 201*a* of the cylindrical section 201. The bottle holding member 300 has an end that is provided with an opening 300*a* from which the connecting part 202 provided on the top end surface 201*d* of the top end portion 201*a* is at least exposed.

As shown in FIG. 7, provided on a surface of the first housing 301 so to be parallel with each other are guide members 303 and 304 for placing the toner supply device 100 in the image forming apparatus 101. Provided between the guide members 303 and 304 is the aforementioned shutter 400 that carries out such a control operation that the toner supplied from the toner supply device 100 is discharged outward. For this reason, the guide members 303 and 304 are at such a level that the space between the bottle holding member 300 and an installation surface of the image forming apparatus 101 is ensured. This allows the shutter 400 to function.

Figure 8:
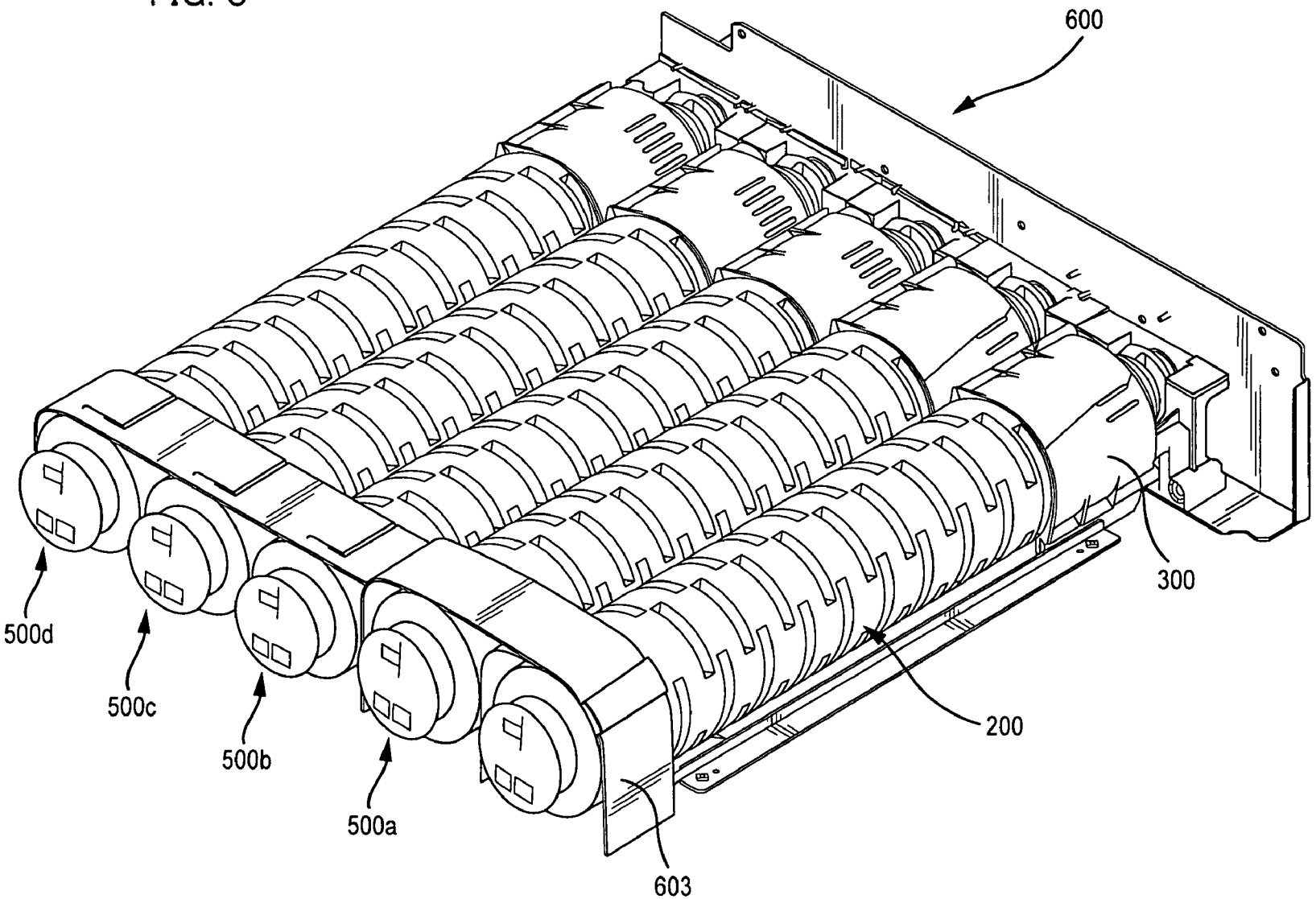
FIG. 8 is a perspective view showing how such toner supply sections as show in FIG. 1(*a*) are mounted on the supporting member.

FIG. 8 is a perspective view showing how the toner supply sections 500*a* to 500*d* are mounted in the supporting member 600. As shown in FIG. 8 the black toner supply sections 500*a*, the cyan toner supply section 500*b*, the magenta toner supply section 500*c*, and the yellow toner supply section 500*d* can be mounted in the supporting member 600.

It should be noted here that the toner bottle 200 is mounted in the supporting member 600 by a holding belt 603. Note that the holding belt 603 causes the toner bottle 200 to be mounted in the supporting member 600 at such an appropriate strength that the toner bottle 200 can be rotated.

Figure 9:
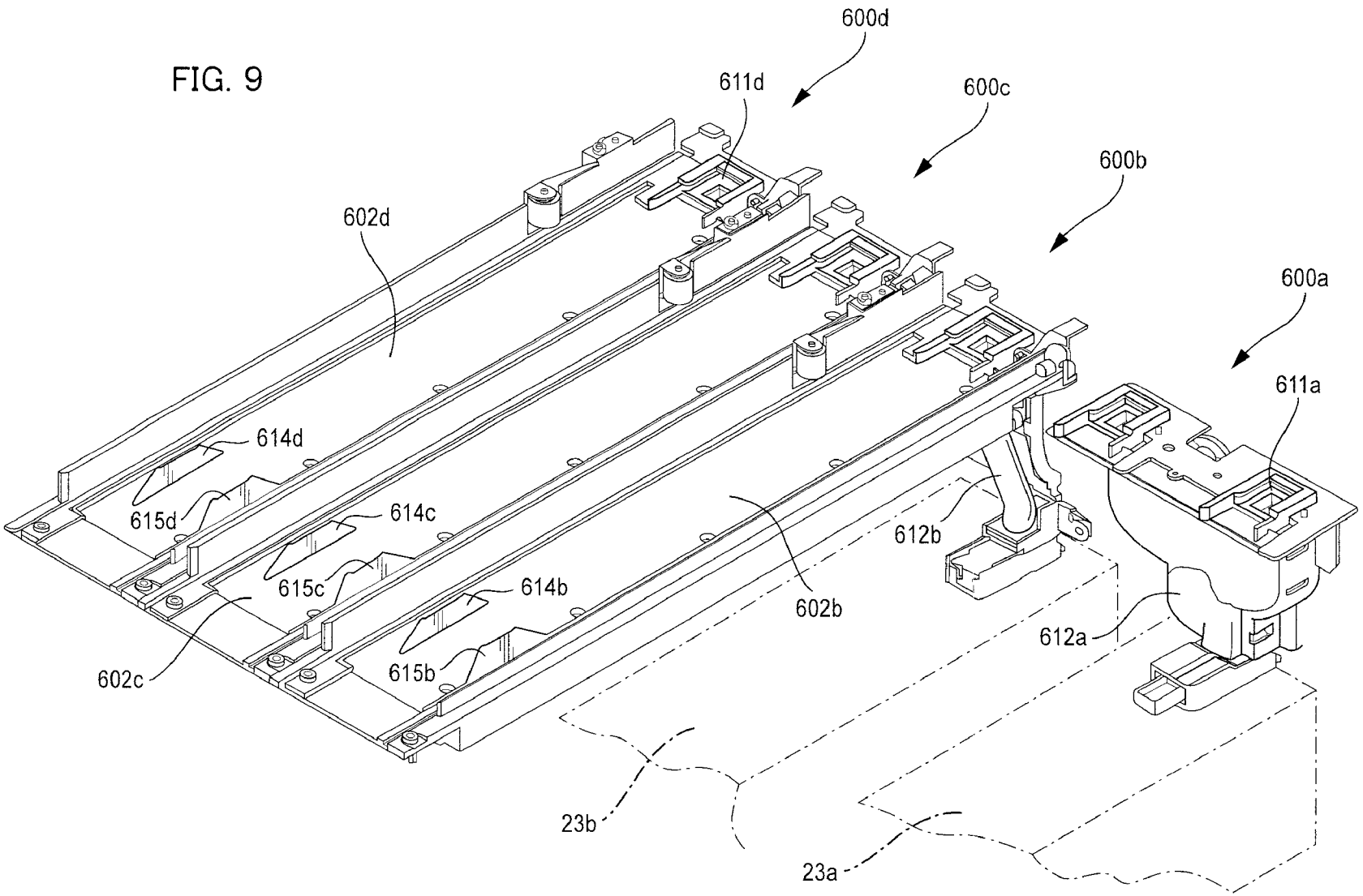
FIG. 9 is a perspective view showing an arrangement of the supporting member of FIG. 8.

FIG. 9 is a perspective view showing an arrangement of the supporting member 600 for supporting the toner bottle 200. For convenience of explanation, FIG. 9 partially omits a mounting base on which the black toner supply sections 500*a* is mounted.

The supporting member 600 mainly includes a mounting base (base) 602 and two plate members 614 and 615. As shown in FIG. 9, that mounting base 602 of the supporting member 600 on which the toner supply section 500 is mounted has an end, provided on an upper surface of the mounting base 602, on which the bottle holding member 300 of the toner supply section 500 is mounted. The end has a toner supply port 611 (611*a*, 611*b*, 611*c*, 611*d*) provided in a place corresponding to the shutter 400 of the bottle holding member 300. Provided below the toner supply port 611 is the toner conveying path 612 (612*a*, 612*b*, 612*c*, 612*d*) communicated with the developing device 23.

The plate members 614 and 615 stand on the mounting base 602 so as to be substantially perpendicular to the upper surface of the mounting base 602 and to be parallel with the central axis Y of the toner bottle 200. Moreover, the two plate members 614 and 615 are disposed so as to face in parallel with each other.

Figure 10:
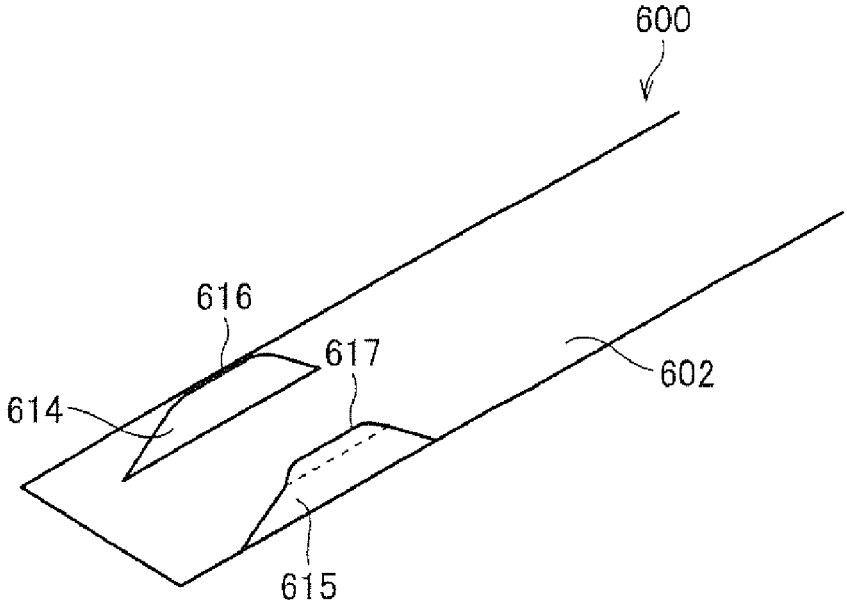
FIG. 10 shows the shapes of plate members of the supporting member of FIG. 9, and is an enlarged view of a main part of FIG. 9.

FIG. 10 shows the shapes of the plate members 614 and 615, and is an enlarged view of a main part of FIG. 9. Each of the plate members 614 and 615 has a substantially trapezoidal shape having two parallel sides, the longer one of which is fixed to the mounting base 602. Further, among the two plate members 614 and 615, the plate member 615 has a top end region (upper region) bent toward the plate member 614. The plate members 614 and 615 have upper sides (edges) 616 and 617, respectively, so that the upper edges 616 and 617 are parallel with the upper surface of the mounting base 602 and are positioned so as to be level with each other.

FIG. 6 is a side view showing how the toner supply section 500 is installed in the supporting member 600. As shown in FIG. 6, the supporting member 600 supports a lower side of the outer circumferential surface near the rear end portion 201*b* of the toner bottle 200 by the upper edges 616 and 617 of the plate members 614 and 615.

Figure 11:
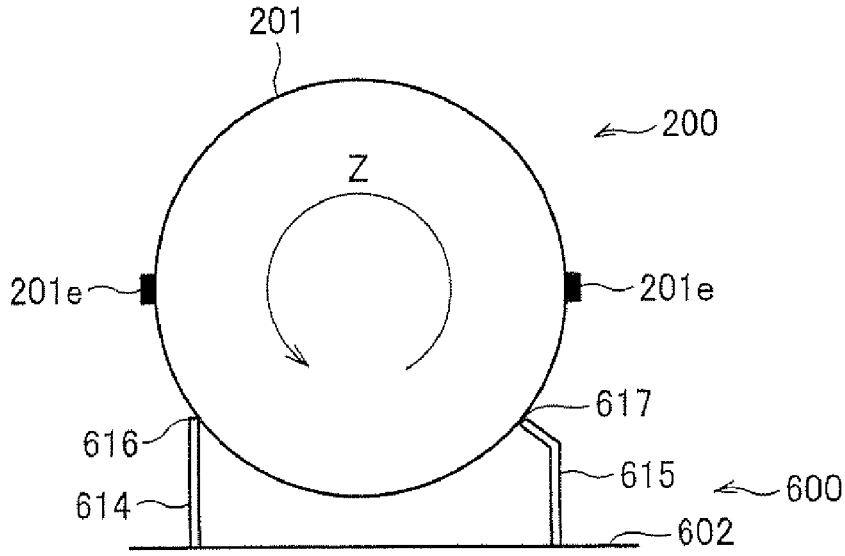
FIG. 11 is a side view showing how the toner supply section of FIG. 1(*a*) is installed in the supporting member of FIG. 9 as seen from a rear end portion of the toner bottle.

It should be noted here that the toner bottle 200 of the present embodiment may have protrusions provided partially on the outer circumferential surface of the cylindrical section 201. The following description assumes that two protrusions 201*e* are provided partially on the outer circumferential surface of the cylindrical section 201. Note that the outer circumferential surface of the cylindrical section 201 does not need to be provided with protrusions. The protrusions 201*e* are disposed in a region closer to the rear end portion 201*b* than the middle of the toner bottle 200 so as not to overlap with the groove portions 201*c*. FIG. 11 is a side view showing how the toner supply section 500 is installed in the supporting member 600 when the two protrusions 201*e* are provided partially on the outer circumferential surface of the cylindrical section 201, as seen from the rear end portion 201*b* of the toner bottle 200. According to the present embodiment, as shown in FIG. 11, the two protrusions 201*e* are disposed on the outer circumferential surface of the cylindrical section 201 so as to be 180° away from each other on the central axis Y and to be at substantially the same distance from the rear end portion 201*b*. The protrusions 201*e* have identical cuboidal shapes level with each other. Further, that inner circumferential surface of the toner bottle 200 which corresponds to the positions of the protrusions 201*e* is flush with the surroundings. This makes it difficult for the toner to adhere.

The two protrusions 201*e* are thus provided on the outer circumferential surface of the cylindrical section 201 of the toner bottle 200, and the edges 616 and 617 of the plate members 614 and 615 touch the toner bottle 200 on the region including the protrusions 201*e*.

When the toner bottle 200 is driven by the driving device 700 to rotate, the edges 616 and 617 of the plate members 614 and 615 of the supporting member 600 repeatedly collide with the two protrusions 201*e* provided on the toner bottle 200. This causes the toner bottle 200 to be vibrated from the protrusions 201*e*. The vibrations cause the toner to peel from the inner circumferential surface of the toner bottle 200.

When each of the protrusions 201*e* has a height of not less than 0.1 mm to not more than 0.5 mm, the burden on the driving system (especially, the connecting part 202 serving as a connecting part between the toner bottle 200 and the driving device 700) can be reduced. It is preferable that each of the protrusions 201*e* have a height of not less than 0.2 mm to not more than 0.3 mm.

Furthermore, the protrusions 201*e* are disposed on the outer circumferential surface of the toner bottle 200 so as be closer to the rear end portion 201*b* than the middle of the direction of the central axis Y (i.e., than an intermediate position between the top end portion 201*a* and the rear end portion 201*b*). Since the protrusions 201*e* are thus positioned away from the driving device 700, the burden on the driving system can be further reduced.

Further, the connecting part 702 of the driving device 700 is arranged to engage in parallel with the top end surface 201*d* of the top end portion 201*a* of the toner bottle 200 so as to transmit driving force. With this, even when the toner bottle 200 is shaken up and down in accordance with the collision between the protrusions 201*e* and the plate members 614 and 615, no space is left between the top end portion 201*a* of the toner bottle 200 and the connecting part 702 of the driving device 700, so that the driving force is transmitted without fail.

EXAMPLE

The following example describes experiments conducted to verify the effects of the present invention. In Experiments 1 to 4 below, toner bottles 200 were prepared by providing existing toner bottles (MX-5500N, manufactured by Sharp Corporation, which have an outer diameter of 88 mm, an inner diameter of 85 mm, and a length of 470 mm and which are made of HDPE (high-density polyethylene)) with protruding portions 201*h* whose shape was changed as shown below. In the present example, no protrusions 201*e* were formed. Further, at an initial stage of each of the experiments, the toner bottle 200 contained 734 g of toner whose main resin is polyester, whose volume mean particle diameter is 6.0 μm, and whose glass-transition temperature is 59° C.

Experiment 1 was conducted to verify a relationship between (a) the proportion of (i) regions (perimeters) 201*i* where the protruding portions 201*h* are not projected when that cross-section of the cylindrical section 201 which is perpendicular to the central axis Y is projected from the longitudinal direction of the cylindrical section 201 to (ii) the entire length of the inner circumference of the cylindrical section 201 and (b) the conveyability of the toner. The number of protruding portions 201*h* provided on the inner circumference of the cross-section of the cylindrical section 201 was 3 or 4. The toner was conveyed while changing the angles, centered on a point onto which the central axis Y is projected, which are formed by those regions (i.e., regions each having a fan-like shape) of the inner circumference where the protruding portions 201*h* are projected (such angles being hereinafter referred to simply as "angles circumferentially formed by the protruding portions 201*h*"). The angles circumferentially formed respectively by the protruding portions 201*h* included on the inner circumference of a single cross-section were identical to one another. The results are shown in FIG. 12(*a*).

When the angles circumferentially formed by the protruding portions 201*h* are small, the protruding portions 201*h* do not overlap with one another on the cross-section, so that there exist regions 201*i* where the protruding portions 201*h* are not projected. That is, the smaller the angles circumferentially formed by the protruding portions 201*h* are, the higher is the proportion of (i) regions 201*i* where the protruding portions 201*h* are not projected to (ii) the entire length of the inner circumference of the cylindrical section 201 (i.e., the proportion at which the protruding portions 201*h* are not formed). On the other hand, as the angles circumferentially formed by the protruding portions 201*h* become larger, the protruding portions 201*h* overlap with one another on the cross-section. This eliminates the regions 201*i* where the protruding portions 201*h* are not projected.

As evidenced by FIG. 12(*a*), the results of Experiment 1 clearly show that the conveyability of the toner is good when the proportion of (i) regions 201*i* where the protruding portions 201*h* are not projected to (ii) the entire length of the inner circumference of the cylindrical section 201 is not less than 4% nor more than 13%.

Each of the protruding portions 201*h* of the toner bottle used in Experiment 1 had a height of 7 mm and a tilt θ of 12° (the tilt θ being an angle at which the protruding portions 201*h* extend so as to be tilted from a direction perpendicular to the central axis Y toward a toner conveying direction).

Experiment 2 was conducted to verify a relationship between the height of the protruding portions 201*h* and the conveyability of the toner. In cases where the number of protruding portions 201*h* provided on the inner circumference of the cross-section of the cylindrical section 201 was 3, all the angles circumferentially formed respectively by the protruding portions 201*h* were set to be 105°. In cases where the number of protruding portions 201*h* was 4, all the angles circumferentially formed respectively by the protruding portions 201*h* were set to be 85°. The toner was conveyed while changing the height of the protruding portions 201*h*. The results are shown in FIG. 12(*b*).

As evidenced by FIG. 12(*b*), the results of Experiment 2 clearly show that the conveyability of the toner is good when the height of the protruding portions 201*h* ranges from 5 mm to 8 mm, i.e., from 5.9% to 9.4% of the inner diameter of the cylindrical section 201. Each of the protruding portions 201*h* of the toner bottle used in Experiment 1 had a tilt θ of 12°.

Experiment 3 was conducted to verify a relationship between the tilt θ of the protruding portions 201*h* and the conveyability of the toner. In cases where the number of protruding portions 201*h* provided on the inner circumference of the cross-section of the cylindrical section 201 was 3, all the angles circumferentially formed respectively by the protruding portions 201*h* were set to be 105°. In cases where the number of protruding portions 201*h* was 4, all the angles circumferentially formed respectively by the protruding portions 201*h* were set to be 85°. The toner was conveyed while changing the tilt θ of the protruding portions 201*h*. The results are shown in FIG. 12(*c*).

As evidenced by FIG. 12(*c*), the results of Experiment 3 clearly show that the conveyability of the toner is good when the tilt θ of the protruding portions 201*h* is not less than 10° nor more than 40°. Each of the protruding portions 201*h* of the toner bottle used in Experiment 1 had a height of 7 mm.

Experiment 4 was conducted to verify the effects of addition of azomethine pigment to the toner bottle 200. A toner bottle was formed from a molding material to which Chromo Fine Black A-1103 (manufactured by Dainichiseika Colour & Chemicals Mfg. Co., Ltd.) has been added as azomethine pigment. Another toner bottle was formed from a molding material to which no azomethine pigment has been added. In cases where the number of protruding portions 201*h* provided on the inner circumference of the cross-section of the cylindrical section 201 was 3, all the angles circumferentially formed respectively by the protruding portions 201*h* were set to be 105°. In cases where the number of protruding portions 201*h* was 4, all the angles circumferentially formed respectively by the protruding portions 201*h* were set to be 85°. The toner was conveyed using these toner bottles. The results are shown in FIG. 12(*d*).

As evidenced by FIG. 12(*d*), the results of Experiment 4 clearly show that the addition of azomethine pigment to a material from which the toner bottle 200 is formed brings about an effect of suppressing toner coagulation. Each of the protruding portions 201*h* of the toner bottles used in Experiment 1 had a height of 7 mm and a tilt θ of 12'.

As described above, a developer container comprises a cylindrical section containing developer therein, the cylindrical section having an inner circumferential surface provided with a plurality of protruding portions raised inward the cylindrical section, which is arranged such that when the cylindrical section is driven to rotate on a central axis of the cylindrical section, the developer stored in the cylindrical section is conveyed along the central axis by the plurality of protruding portions so as to be discharged an outlet of the cylindrical section, wherein when cross-sections perpendicular to the central axis of the cylindrical section are projected from a longitudinal direction of the cylindrical section, the cylindrical section has an inner circumference provided with one or more regions where the protruding portions are not projected.

Further, in addition to the foregoing arrangement, the developer container may be arranged such that the plurality of protruding portions extend so as to be tilted from a direction perpendicular to the central axis toward a developer conveying direction and are disposed so as not to be on an extension of one another.

According to the foregoing arrangement, the plurality of protruding portions extend so as to be tilted from a plane of rotation toward the developer conveying direction, and the plurality of protruding portions are disposed so as not be on an extension of one another. Such a way of providing the protruding portions makes it possible to prevent frictional heat from being concentrated on the developer being in contact with the protruding portions. This makes it possible to effectively suppress toner coagulation.

Further, in addition to the foregoing arrangement, the developer container may be arranged such that the plurality of protruding portions have a height of a range between 5.9% and 9.4% of an inner diameter of the cylindrical section.

According to the foregoing arrangement, the plurality of protruding portions are provided so as to have a height of a range between 5.9% and 9.4% of the inner diameter. The range moderately ensures the conveyability of the developer, thereby causing the developer to be efficiently conveyed.

Further, in addition to the foregoing arrangement, the developer container may be arranged such that the plurality of protruding portions are tilted at an angle of not less than 10° nor more than 40° from the direction perpendicular to the central axis toward the developer conveying direction.

According to the foregoing arrangement, the plurality of protruding portions are provided so as to be tilted at an angle of not less than 10° nor more than 40° from the direction perpendicular to the central axis toward the developer conveying direction. Therefore, the force of rotation of the cylindrical section can be effectively used for conveying the developer.

Further, in addition to the foregoing arrangement, the developer container may be arranged such that the plurality of protruding portions are repeatedly disposed in a given shape from an end opposite to the outlet of the cylindrical section to a near side of a developer discharging section provided with the outlet.

According to the foregoing arrangement, the plurality of protruding portions are repeatedly disposed in a given shape from an end opposite to the outlet of the cylindrical section to a near side of a developer discharging section provided with the outlet. Therefore, the frictional heat applied to the developer is not changed between the end opposite to the outlet of the cylindrical section and a near side of the developer discharging section provided with the outlet. This makes it difficult for the developer to coagulate.

Further, in addition to the foregoing arrangement, the developer container is preferably arranged such that those regions of the inner circumference of the cross-section of the cylindrical section where the plurality of protruding portions are not projected occupy not less than 4% nor more than 13% of an entire length of the inner circumference of the cylindrical section.

When the regions where the protruding portions are not projected occupy less than 4% of the entire length of the inner circumference of the cylindrical section, the developer becomes likely to coagulate. On the other hand, when the regions where the protruding portions are not projected occupy more than 13% of the entire length of the inner circumference of the cylindrical section, the conveyability of the developer is lowered. Therefore, when the regions where the protruding portions are not projected occupy not less than 4% nor more than 13% of the entire length of the inner circumference of the cylindrical section, the developer can be efficiently conveyed by suppressing coagulation.

Further, in addition to the foregoing arrangement, the developer container may be arranged such that the cylindrical section is formed from a material to which azomethine pigment has been added.

According to the foregoing arrangement, the cylindrical section is formed from a material to which azomethine pigment has been added. Therefore, the cylindrical section is given excellent heat-shielding properties. The excellent heat-shielding properties make it possible to prevent external heat from being transmitted to the developer stored in the developer container, and to thereby better prevent the developer from coagulating.

Further, the developer container may be such that the developer stored in the cylindrical section is toner having a volume mean particle diameter between 4 μm and 8 μm.

The smaller volume mean particle diameter the toner has, the more likely the toner is to coagulate. The developer container thus arranged can go so far as to suppress the coagulation of coagulation-prone toner having a volume mean particle diameter between 4 μm and 8 μm, and can cause the toner to be effectively conveyed.

It should be noted here that when the toner has a glass-transition temperature of not more than 60° C., the developer container thus arranged exerts its effect remarkably. That is, the developer container thus arranged to suppress the coagulation of a developer exerts its effect on the toner, designed to be surely fixed at low temperature, which is likely to be coagulated by heat.

Further, in addition to the foregoing arrangement, the developer container may be arranged such that the cylindrical section has an outer circumferential surface provided with one or more protrusions that repeatedly collide with contact members while the cylindrical section is being driven to rotate.

According to the foregoing arrangement, when the developer container is driven to rotate, the protruding portions repeatedly collide with the contact members, so that the developer container is vibrated. The vibrations cause the developer to peel from the inner circumferential surface of the developer container. Further, the vibrations make it possible to prevent the developer from coagulating. Therefore, the developer can be more effectively prevented from remaining in the developer container.

Further, a developer supply device includes a developer container according to any one of the arrangements in this disclosure.

Further, an image forming apparatus made using the disclosed technology includes the developer supply device.

Since the foregoing arrangement includes a developer supply device including a developer container made according to the disclosed technology, the foregoing arrangement can ensure the supply of a developer, thereby maintaining printing quality. Conventionally, there has been a situation where a signal to replace a developer container is transmitted due to the coagulation of a developer even though the developer container still contains the developer. However, the foregoing arrangement can prevent such a situation, and can transmit a signal for replacement at an appropriate time.

The present technology can be applied to toner bottles for use in electrophotographic image forming apparatuses such as printers, copiers, fax machines, and MFPs (Multi Function Printers).

The embodiments and concrete examples of implementation discussed in the foregoing detailed explanation serve solely to illustrate the technical details of the technology, which should not be narrowly interpreted within the limits of such embodiments and concrete examples, but rather may be applied in many variations within the spirit of the present disclosure, provided such variations do not exceed the scope of the patent claims set forth below.

What is claimed is:

1. A developer container, comprising a cylindrical section containing developer therein, the cylindrical section having an inner circumferential surface provided with a plurality of protruding portions raised inward along the cylindrical section, which is arranged such that when the cylindrical section is driven to rotate on a central axis of the cylindrical section, the developer stored in the cylindrical section is conveyed along the central axis by the plurality of protruding portions so as to be discharged from an outlet of the cylindrical section, wherein the plurality of protruding portions are tilted at an angle of not less than 10° nor more than 40° from the direction perpendicular to the central axis toward the developer conveying direction, wherein a height of the protruding portions ranges between approximately 5.9% and 9.4% of an inner diameter of the cylindrical section, and wherein when cross-sections perpendicular to the central axis of the cylindrical section are projected from a longitudinal direction of the cylindrical section, the cylindrical section has an inner circumference provided with one or more regions where the protruding portions are not projected, and wherein those regions of the inner circumference of the cross-section of the cylindrical section where the plurality of protruding portions are not projected occupy not less than 4% nor more than 13% of an entire length of the inner circumference of the cylindrical section.

2. The developer container as set forth in claim 1, wherein the plurality of protruding portions are disposed so as not to be on an extension of one another.

3. The developer container as set forth in claim 1, wherein the plurality of protruding portions are repeatedly disposed in a given shape from an end opposite to the outlet of the cylindrical section to a near side of a developer discharging section provided with the outlet.

4. The developer container as set forth in claim 1, wherein the cylindrical section is formed from a material to which azomethine pigment has been added.

5. The developer container as set forth in claim 1, wherein the developer stored in the cylindrical section is toner having a volume mean particle diameter of 4 μm to 8 μm.

6. The developer container as set forth in claim 5, wherein the toner has a glass-transition temperature of not more than 60° C.

7. The developer container as set forth in claim 1, wherein the cylindrical section has an outer circumferential surface provided with one or more protrusions that repeatedly collide with contact members while the cylindrical section is being driven to rotate.

8. A developer supply device comprising a developer container, comprising a cylindrical section containing developer therein, the cylindrical section having an inner circumferential surface provided with a plurality of protruding portions raised inward along the cylindrical section, which is arranged such that when the cylindrical section is driven to rotate on a central axis of the cylindrical section, the developer stored in the cylindrical section is conveyed along the central axis by the plurality of protruding portions so as to be discharged from an outlet of the cylindrical section, wherein the plurality of protruding portions are tilted at an angle of not less than 10° nor more than 40° from the direction perpendicular to the central axis toward the developer conveying direction, wherein a height of the protruding portions ranges between approximately 5.9% and 9.4% of an inner diameter of the cylindrical section, and wherein when cross-sections perpendicular to the central axis of the cylindrical section are projected from a longitudinal direction of the cylindrical section, the cylindrical section has an inner circumference provided with one or more regions where the protruding portions are not projected, and wherein those regions of the inner circumference of the cross-section of the cylindrical section where the plurality of protruding portions are not projected occupy not less than 4% nor more than 13% of an entire length of the inner circumference of the cylindrical section.

9. The developer supply device as set forth in claim 8, the cylindrical section of the developer container has an outer circumferential surface provided with one or more protrusions that repeatedly collide with contact members while the cylindrical section is being driven to rotate, the developer supply device comprising a supporting member for supporting the developer container, the supporting member being provided in that region of the outer circumferential surface of the cylindrical section which is provided with the protrusions.

10. The developer supply device as set forth in claim 8, wherein the plurality of protruding portions are disposed so as not to be an extension of one another.

11. An image forming apparatus comprising a developer supply device which includes a developer container, comprising a cylindrical section containing developer therein, the cylindrical section having an inner circumferential surface provided with a plurality of protruding portions raised inward along the cylindrical section, which is arranged such that when the cylindrical section is driven to rotate on a central axis of the cylindrical section, the developer stored in the cylindrical section is conveyed along the central axis by the plurality of protruding portions so as to be discharged from an outlet of the cylindrical section, wherein the plurality of protruding portions are tilted at an angle of not less than 10° nor more than 40° from the direction perpendicular to the central axis toward the developer conveying direction, and wherein a height of the protruding portions ranges between approximately 5.9% and 9.4% of an inner diameter of the cylindrical section, and wherein when cross-sections perpendicular to the central axis of the cylindrical section are projected from a longitudinal direction of the cylindrical section, the cylindrical section has an inner circumference provided with one or more regions where the protruding portions are not projected, and wherein those regions of the inner circumference of the cross-section of the cylindrical section where the plurality of protruding portions are not projected occupy not less than 4% nor more than 13% of an entire length of the inner circumference of the cylindrical section.

12. The image forming apparatus as set forth in claim 11, wherein the plurality of protruding portions are disposed so as not to be an extension of one another.

* * * * *